US009386870B2

(12) United States Patent
Rossitto

(10) Patent No.: US 9,386,870 B2
(45) Date of Patent: Jul. 12, 2016

(54) CHECK VALVE DRINKING DEVICE

(76) Inventor: Caesar Rossitto, Wethersfield, CT (US)

( * ) Notice: Subject to any disclaimer, the term of this patent is extended or adjusted under 35 U.S.C. 154(b) by 573 days.

(21) Appl. No.: 13/184,590

(22) Filed: Jul. 18, 2011

(65) Prior Publication Data

US 2012/0012597 A1 Jan. 19, 2012

Related U.S. Application Data

(60) Provisional application No. 61/365,383, filed on Jul. 19, 2010.

(51) Int. Cl.
*A47G 21/18* (2006.01)
*A61J 15/00* (2006.01)

(52) U.S. Cl.
CPC ..... *A47G 21/18* (2013.01); *A47G 2400/027* (2013.01)

(58) Field of Classification Search
CPC ..... A61J 7/0023; A47G 21/184; A47G 21/18; A47G 21/182; A47G 2400/027; B65D 77/283
USPC ..... 239/33, 16; 220/705
See application file for complete search history.

(56) References Cited

U.S. PATENT DOCUMENTS 3,438,527 A 4/1969 Gamblin
4,034,780 A * 7/1977 Horvath ..... 137/527.8
4,196,747 A 4/1980 Quigley et al.
6,050,444 A 4/2000 Sugg
6,273,128 B1 8/2001 Paczonay
2005/0092373 A1 5/2005 Schafer et al.
2005/0242204 A1 11/2005 Ness et al.
2008/0075809 A1 * 3/2008 Anderson ..... 426/85
2008/0245531 A1 * 10/2008 Noske et al. ..... 166/373

FOREIGN PATENT DOCUMENTS

WO WO 94/14400 * 7/1994

* cited by examiner

*Primary Examiner* — Dinh Q Nguyen
(74) *Attorney, Agent, or Firm* — Daniel Boudwin; Global Intellectual Property Agency, LLC

(57) ABSTRACT

A fluid control drinking device is provided for reducing the backflow of fluid from a drinking straw into a larger container after a user has ceased drawing a vacuum on the outlet end. The device comprises a fluid conduit and a check valve. The conduit may be a standard drinking straw or similar structure. The check valve is a one-way hinge closure which acts as a sealing flap. Suction is applied by a drinking user, which results in the sealing flap rotating upwardly about its hinge. In this open position, liquid is allowed to flow through the conduit and past the sealing flap so that a user may drink from the straw outlet end. Cessation of suction causes the flap to return to a resting state, sealing off the fluid conduit and preventing fluid from returning to the container. In this way, the straw is continually filed with liquid, illuminating large pockets of air that the user ingests upon a subsequent suction.

5 Claims, 2 Drawing Sheets

CHECK VALVE DRINKING DEVICE

CROSS REFERENCE TO RELATED APPLICATION

Figure 1:
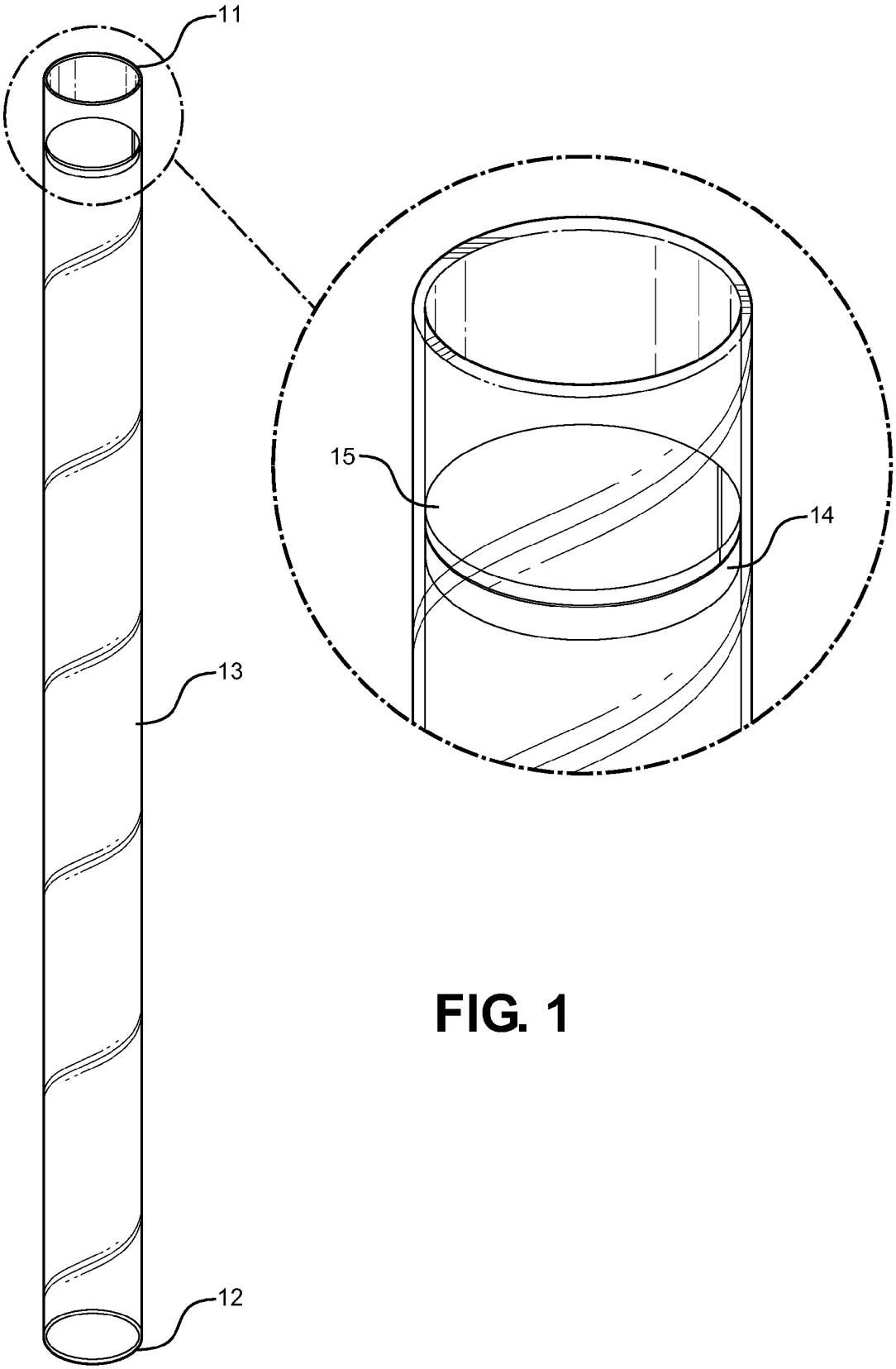

This application claims the benefit of U.S. Provisional Application No. 61/365,383 filed on Jul. 19, 2010, entitled "Check Valve for Drinking Straw."

BACKGROUND OF THE INVENTION

1. Field of the Invention

The present invention relates to a fluid suction device, and more specifically to a drinking straw device for controlling the flow of liquid through a drinking conduit between uses.

Beverage drinkers often utilize elongated straws as a means for transferring liquid from a larger container for consumption thereof. Straws may be used for several reasons. For safety reasons, a straw may be utilized to reduce the risk of ingesting germs along the rim of a drinking glass in a public restaurant or other setting. They are also commonly used in the health care field for injured patients who may have difficulty drinking directly from a cup, by the elderly or infirm, or other similar individuals who may have difficulty holding a glass or exercising control of muscles to facilitate drinking. A common problem experienced by straw users everywhere is that substantial suction must be applied to the outlet end of a straw every time a drink is required. This may prove difficult for persons who have poor muscular control in their jaws or tongue. Additionally this requirement of applying substantial suction each time a drink is desired results in the unnecessary ingestion of air that is pulled into the drinking straw after each drink. Ingestion of air can result in bloating of a user's stomach and lead to gas related discomfort or inappropriate belching.

To reduce the amount of suction required and volume of air ingested prior to each sip, devices have been created to reduce the flow of liquid out of a drinking conduit once a user has ceased drinking. Some of these devices are attachments that affix to the end of a straw, or may be placed between two straws. Others are integrated into the straw itself. Common forms of providing a check valve include: ball vales that float in liquid when suction is applied and block the drinking straw when suction ceases, as well as elastic diaphragms that deform upon application of suction. These devices tend to be overly complicated, increasing the likelihood that a portion will malfunction and render the drinking device inoperable. Ball stoppers are prone to jamming within the conduit, while elastic diaphragms may tear if too much suction is applied. The present invention solves these problems by providing a single check valve integrated into and enclosed within a standard drinking straw.

2. Description of the Prior Art

The prior art contains a variety of fluid control drinking devices for maintaining a column of fluid within the drinking device between uses. These devices have familiar design and structural elements; however they are not adapted for the task of providing a check valve within a standard drinking straw to maintain a static column of fluid between straw uses.

Schafer, U.S. Patent Application Publication No. 2005/0092373 discloses an apparatus for insertion into a drinking straw to prevent fluid from flowing back down the straw and into the drink when vacuum pressure is not being applied. The fluid retaining apparatus has a ball valve comprising a valve chamber with a valve seat at the inlet end thereof and a ball that can move between the ends of the valve chamber. The inlet valve seat is shaped such that when fluid is not being drawn through the drinking tube, the ball will sit in the inlet valve seat and prevent fluid from flowing out of the tube back through the inlet of the valve chamber. Ribs extending inwardly at the outlet end of the valve chamber prevent the ball from closing the outlet end of the valve chamber and blocking fluid movement. Extending from the outlet end of the valve chamber is an upper tapered tubular portion that allows the apparatus to be placed into a tube, such as a drinking straw. While Schafer discloses a device with a similar purpose as that of the present invention, it does not disclose a check valve flap inside the drinking straw to prevent fluid from exiting the lower end of the straw between applications of suction by the user.

Gamblin, U.S. Pat. No. 3,438,527 discloses a drinking straw that has contains within, a small preferably elastic hollow device that seals the entrance or is disposed completely across the interior of a drinking straw. The elastic device is made of rubber, plastic or other suitable elastic material and has an opening directed toward the end of the straw used by the person drinking. The device is secured in place by one or more appropriate means. Upon the development of suction above the device, the device collapses, fluid flows through the straw until suction is terminated. Termination of suction permits the device to expand to its original size, thereby again sealing the straw. The present invention is directed to a flap that lifts and lowers upon application of pressure, similar to a hinged check valve in a pipe, as opposed to the elastic device of the Gamblin patent.

Sugg, U.S. Pat. No. 6,050,444 discloses a beverage dispenser having a collapsible beverage container, a valve assembly, and a flexible tube or straw. The collapsible beverage container has at least one opening and the valve assembly is secured to the container at the opening. The valve assembly includes a flexible diaphragm disposed across the flow path such that beverage flow is permitted only outwardly from the container. The flexible tube extends outwardly from the valve assembly. When a user exerts sucking action on the end of the flexible tube, beverage is made to flow from the container out through the one-way valve assembly and into the flexible tube. As beverage is withdrawn, the container collapses and, when the user stops drinking, the flexible diaphragm closes to prevent air and back flow from entering the container. Similar to aforementioned prior art patents, the mechanism for preventing backflow of fluid differs in the Sugg patent. The present invention provides a hinged flap for the purposes of preventing fluid flow from a straw, as opposed to a diaphragm.

Quigley, U.S. Pat. No. 4,196,747 discloses a drinking straw apparatus having a valve member. Said valve member comprising a chamber that attaches at its top and bottom ends to straw portions and has a flapper disposed at its bottom end. When suction is applied to the straw the flapper lifts up to allow fluid to flow through the valve chamber, and when suction ceases the flap returns to a rest state over the drinking straw. This straw apparatus is not enclosed within a normal drinking straw and requires the use of an unwieldy valve chamber to house the flapper. Quigley also requires multiple straws unlike the present invention, which consists of a unitary straw member.

Ness, U.S. Patent Application Publication No. 2005/0242204 discloses an anti-leak drinking straw system comprising squeeze operable check valves for use with straws and cup lids. The system comprises a first and second check valve opened simultaneously by a squeezing means. The first check valve reduces the forward flow of fluid through the drinking straw while the second check value reduces the backward flow of fluid through the straw. When the squeezing means is depressed, pressure in the straw causes the first and second checks valves to open, allowing liquid to flow unhampered through the drinking straw. The present invention is a passive device that does not require a squeezing means to operate. Ness further does not disclose a hinged flap housed within a drinking conduit, as disclosed in the present invention.

Paczonay, U.S. Pat. No. 6,273,128 a drinking apparatus for controlling the flow of fluid through a conduit including a gravity sensitive valve for receiving fluid from a conduit, and a pressure activated valve. Said gravity sensitive valve prevents the flow of fluid forward through the conduit. The pressure activated valve comprises a valve housing, an elastic diaphragm, and a wall attached hingedly thereto. When a user sucks on a tube attached to the system, suction is exerted on the pressurization valve, deforming the diaphragm and allowing fluid to pass through. Paczonay does not disclose a hinged flap within the conduit, nor does it disclose the conduit as a drinking straw.

The devices disclosed by the prior art do not address the need for a single check valve enclosed within a drinking conduit, and one that operates based on user generated suction alone. The current invention relates to a device for maintaining a column of fluid within a drinking straw and between applications of suction by a user to eliminate large air pockets within the straw. Large air pockets require increased suction to draw fluid from a coupled beverage container, while at the same time introduce the enclosed air into the stomach of a user. The present invention therefore substantially diverges in design elements from the prior art; consequently it is clear that there is a need in the art for an improvement to the existing fluid control drinking devices. In this regard the instant invention substantially fulfills these needs.

SUMMARY OF THE INVENTION

In view of the foregoing disadvantages inherent in the known types of fluid control drinking devices now present in the prior art, the present invention provides a new drinking conduit device having a check valve for fluid control wherein the same can be utilized for providing convenience for the user when drinking liquid using a drinking straw device. The drinking conduit device comprises a drinking conduit and a hingedly attached, internally mounted check valve. The drinking conduit has an outlet end and an inlet end, along with a tubular wall structure defining a fluid passageway therebetween. The check valve comprises a cylindrical ring abutting the walls of the fluid passageway and hingedly attached to a circular sealing flap. A hinge attaches the flap to the cylindrical ring such that the flap can only open in a single direction, aligned with the straw outlet direction as the user applies suction to withdrawal fluid from a larger container by means of the conduit. Suction created by a user attempting to drink from the fluid conduit draws the flap upward. If the flap is in its open position, liquid can flow freely through the conduit and through the valve ring, thus permitting a user to drinking as normally experienced with a traditional drinking straw. If suction is ceased, the flap returns to its original state, covering the valve ring and sealing the conduit. This seal prevents the flow of fluid from the conduit and back into the beverage container, as no air can pass through the valve seat and a vacuum is maintained. In this manner, fluid is retained within the drinking conduit to facilitate improved drinking for a user.

It is therefore an object of the present invention to provide a new and improved fluid control drinking device having all the advantages of the prior art and none of the disadvantages.

Another object of the present invention is to provide a new and improved fluid control drinking device having a check valve enclosed within a drinking conduit and requiring no special setup or multiple straw configurations.

Yet another object of the present invention is to provide a new and improved fluid control drinking device for maintaining a static column of fluid within a drinking conduit between user applications of suction, eliminating any backward flow of fluid into the container which would cause an air void in the conduit.

Still another object of the present invention is to provide a new and improved fluid control drinking device having durable and resilient construction, including a simple mechanism that can be manufactured at a relatively low cost.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein FIG. 1 shows a perspective view of a fluid control drinking device according to the present invention with a magnified view of the device's outlet end, wherein a check valve enclosed therein.

Figure 2:
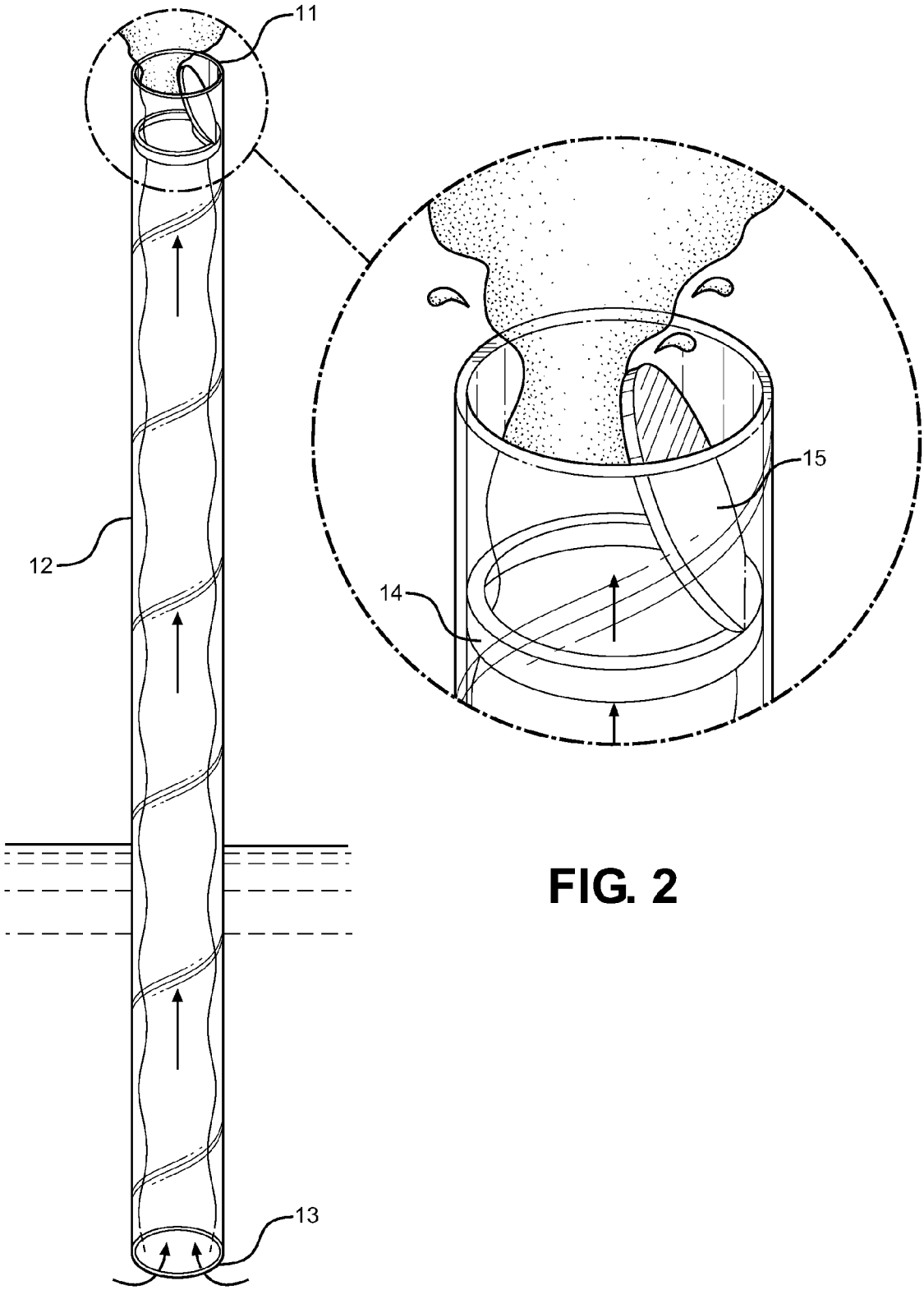

FIG. 2 shows a perspective view of a fluid control drinking device according to the present invention while in use. A magnified view of the device outlet end is shown in an open position, allowing fluid to flow through the conduit as suction is drawn by the user.

DETAILED DESCRIPTION OF THE INVENTION

Reference is made herein to the attached drawings. Like reference numerals are used throughout the drawings to depict elements of the fluid control drinking device. For the purposes of presenting a brief and clear description of the present invention, the preferred embodiment will be discussed as used for maintaining a column of liquid within a drinking conduit between user applications of suction. The drawings are intended for representative purposes only and should not be considered limiting in any respect.

Referring now to FIG.FIG. 1, there is shown a side perspective view of a fluid control drinking device. The device comprises a fluid conduit having a check valve mechanism enclosed within the interior of the conduit and biased to one end of the conduit. Said fluid conduit comprises an outlet end 11, an inlet end 12, and a conduit wall defining a cylindrical fluid passageway 13 lying therebetween. This fluid conduit may be a rigid drinking straw or may have a flexible accordion portion that allows a radius to be incorporated into the length of the fluid passageway 13. The outlet end of the fluid conduit is placed in a user's mouth while the inlet end 12 is placed below the surface of a volume of liquid. The check valve mechanism includes a largely circular flap 15, attached to the conduit walls by a hinge and a valve ring 14. The valve ring 14 acts as a sealing ring for the circular flap 15 to bear against when in its static, closed position. The diameter of the circular flap 15 is equal to the interior diameter of the cylindrical fluid passageway 13 within a close tolerance in order to prevent fluid flow therethrough when the circular flap 15 is in its static, closed position. This position is illustrated in FIG.FIG. 1, wherein the flap 15 is closed as no suction is being drawn from the drinking device outlet end 11. The closed position prevents fluid within the conduit passageway 13 from exiting the same, as a vacuum is generated between the flap 15 and the fluid. The vacuum prevents the fluid from exiting the conduit through the outlet end 12 by means of gravity, keeping a constant column of liquid within the passageway 13 for the user to access.

Referring now to FIG.FIG. 2, there is shown a perspective view of a fluid control drinking device in use. The check valve in its working position is displayed in a magnified view. The check valve mechanism comprises a valve ring 14 and a sealing flap 15. The valve ring is a cylindrical structure mounted along the interior wall of the conduit, creating a bump-out within the interior cavity of the fluid passageway 13. The outer surface of the valve ring 14 abuts the interior surface of the fluid passageway 13, resulting in a close-tolerance fit that eliminates shifting of the valve ring 14 while liquid is flowing through the passageway 13 and while a suction is being drawn on the outlet end 11. A sealing flap 15 is hingedly attached to a portion of said valve ring 14 such that the flap 15 may only swing in an upward direction. This single degree of freedom results in two positions for the flap 15, a closed state wherein the flap 15 is lying flat in registry with the valve ring 14, or a working state wherein the flap 15 is rotated upward about its hinge and allows fluid to flow therethrough. When suction is applied to the device by a drinking user, the sealing flap 15 transitions into a working position, allowing liquid to flow through the valve ring 14 and consequently through the fluid passageway 13. Cessation of suction causes the sealing flap to return to its closed state, ceasing fluid flow through the valve ring 14 and causing fluid to be retained within the conduit interior. Materials contemplated for the device include plastic, rubber, or any durable, flexible material that is safe for placement into a human mouth.

In use an individual places the device into a volume of drinking liquid, such that the inlet end is submerged beneath the surface of the liquid. The user then places his or her mouth over the outlet end of device and begins to exert suction on the same. This suction lifts the sealing flap upwards into its working position, allowing liquid to be drawn into the inlet end and up the fluid passageway, through the valve ring, out of the outlet end and into a user's mouth. If a user ceases application of suction on the outlet end, the flap will return to a closed state and seal the check valve closed, thus preventing liquid from moving backward within the device and out through the inlet end. Air is not permitted through the check valve device, creating a sealed vacuum that provides a static column of fluid to be maintained within the conduit without further vigilance of the user. In this manner, drinking is made easier for a user by requiring less suction during each drinking attempt, which would otherwise be required to draw liquid through the entire length of the conduit wherein an air pocket would be located. Elimination of an air pocket allows the fluid to be kept to an elevation within the conduit that only minor suction is required to draw the fluid into the user's mouth. Further, no air is entered into the user's mouth or stomach during operation of the present invention, which greatly reduces gas build-up during beverage intake.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. A fluid control drinking device, comprising:

a fluid conduit having an inlet end, an outlet end, and a fluid passageway defined therebetween;

a check valve disposed within said fluid conduit and positionally biased toward said outlet end;

wherein said check valve comprises a valve ring, said valve ring fitting snuggly against an interior surface of said fluid conduit, and a sealing flap attached via a hinge to said valve ring and capable of rotating upward about said hinge;

wherein a diameter of said sealing flap is equal to an interior diameter of said fluid conduit within a close tolerance;

said check valve creates a vacuum that prevents the flow of liquid from said fluid conduit inlet end when suction is not being applied by a drinking user.

2. The device of claim 1, wherein said check valve is snuggly fit with sufficient pressure to hold said check valve in place along said conduit while a user is applying suction to said conduit.

3. The device of claim 1, wherein:

said sealing flap has a closed position, lying in registry with said valve ring and creating a seal;

said sealing flap having a working position, upwardly hinged such that liquid is permitted to flow freely through said valve ring when suction is applied by a user.

4. The device of claim 1, wherein:

said fluid conduit comprises a cylindrical drinking straw.

5. A fluid control drinking device comprising:

a fluid conduit having an inlet end, an outlet end, and a fluid passageway defined therebetween;

a check valve disposed within said fluid conduit and positionally biased toward said outlet end, said check valve creates a vacuum that prevents the flow of liquid from said fluid conduit inlet end when suction is not being applied by a drinking user;

a valve ring, said valve ring fitting snuggly against an interior surface of said fluid conduit;

a sealing flap attached via a hinge to said valve ring and capable of rotating upward about said hinge;

wherein a diameter of said sealing flap is equal to an interior diameter of said fluid conduit within a close tolerance;

said sealing flap has a closed position, lying in registry with said valve ring and creating a seal;

said sealing flap having a working position, upwardly hinged such that liquid is permitted to flow freely through said valve ring when suction is applied by a user.

* * * * *